United States Patent [19]

Nakamura et al.

[11] Patent Number: 5,049,904

[45] Date of Patent: Sep. 17, 1991

[54] PRINTER HAVING IDENTIFIABLE INTERCHANGEABLE HEADS

[75] Inventors: Mitsuaki Nakamura; Itaru Kohsaka, both of Kyoto, Japan

[73] Assignee: Shimadzu Corporation, Kyoto, Japan

[21] Appl. No.: 458,885

[22] Filed: Dec. 29, 1989

[30] Foreign Application Priority Data

Jan. 27, 1989 [JP] Japan ..... 1-19285

[51] Int. Cl.[5] ..... B41J 2/32; B41J 2/015

[52] U.S. Cl. ..... 346/140 R; 346/75; 346/76 PH

[58] Field of Search ..... 346/140 R, 76 PH, 139 C, 346/76 L, 75

[56] References Cited

U.S. PATENT DOCUMENTS 4,396,923 8/1983 Noda ..... 346/76 PH
4,554,559 11/1985 Heath ..... 346/76 PH
4,803,500 2/1989 Milbrandt ..... 346/140 R
4,872,027 10/1989 Buskirk et al. ..... 346/140 R

*Primary Examiner*—Benjamin R. Fuller
*Assistant Examiner*—Victor DeVito
*Attorney, Agent, or Firm*—Koda and Androlia

[57] ABSTRACT

A printer devised so as to function both as a thermal printer and as an ink-jet printer. The printer having a thermal printing head cartridge, an ink-jet printing head cartridge, a cartridge holder, an electronic circuit and a sensor for identifying a printing head cartridge in use. If one of the above two kinds of printing head cartridges is optionally selected and mounted on the cartridge holder, the sensor outputs a signal of identifying which one of the printing head cartridges is mounted. Receiving the signal, the electronic circuit supplies to a printing head cartridge mounted on the cartridge holder pulse currents suitable for the specific resistors installed in the printing head cartridge for making the same function as a printing head.

3 Claims, 5 Drawing Sheets

PRINTER HAVING IDENTIFIABLE INTERCHANGEABLE HEADS

BACKGROUND OF THE INVENTION

The present invention relates to a printer of the type that prints characters and the like by means of a printing head successively on a paper sheet fed on a platen roller, and more particularly to such a printer having the printing head devised so as to be changeable with another type printing head.

Conventional printers whose printing mechanism consists essentially of a platen roller and a printing head for printing characters on a paper sheet fed on the platen roller can be classified tentatively into three types by the type of printing head used: an ink-jet type, a thermal type and a printing ribbon type. Of these three types, the last printing ribbon type printer is outside the present invention.

The ink-jet type printer, in which the printing head is made up of a set of ink-jet nozzles combined with an ink fountain into a unit, has an advantage that the print face is clear and durable, and therefore, suitable for printing a formal document, definitive scientific data and others to be kept clear for a long term. However, the printer of this type has a disadvantage that the ink stored in the printing head may happen to be exhausted midway of printing continuously for a long time, for instance, in the case of printing a long series of data outputted from a scientific instrument automatically operating continuously. On the contrary, the thermal type printer, in which the printing head made up of a plurality of dot resistors thermally print characters on a thermal sensitive paper sheet, is free from such a disadvantage, but has a drawback that the printed characters are undurable and apt to fade away because the thermosensible paper is made to change color by heat and infrared radiations contained in the day light and ordinary lighting. Accordingly, the thermal type printer is unsuitable for printing a document or data to be kept clear for a long period of time.

Such being the case, in many science laboratories, these two types of printers have conventionally been used properly in accordance with different printing purposes.

OBJECTS AND SUMMARY OF THE INVENTION

The present invention aims at eliminating the above inconvenience involved in using printers, and makes it an object to provide a printer improved so as to serve both as an ink-jet type printer and as a thermal type printer.

Another object of the present invention is to construct such an improved printer in a simple form by making the printing head of the printer changeable between an ink-jet type printing head and a thermal type printing head.

To achieve the above objects, the essential part of a printer according to the present invention comprises an ink-jet type printing head cartridge, a thermal type printing head cartridge, a cartridge holder devised so as to accept any optionally selected one of the above two types of printing head cartridges, a sensor for detecting which type of the cartridges is mounted on the cartridge holder, and an electronic circuit for supplying pulse currents to heating resistors installed in the respective printing head cartridges.

Instructed by a signal outputted from the sensor, the pulse currents supplied by the electronic circuit have their pulse width varied in accordance with the type of the printing head cartridge mounted on the cartridge holder.

BRIEF DESCRIPTION OF THE DRAWINGS

In the following the present invention is described in further detail with reference to the accompanying drawings, in which.

DETAILED DESCRIPTION OF THE INVENTION

Figure 1:
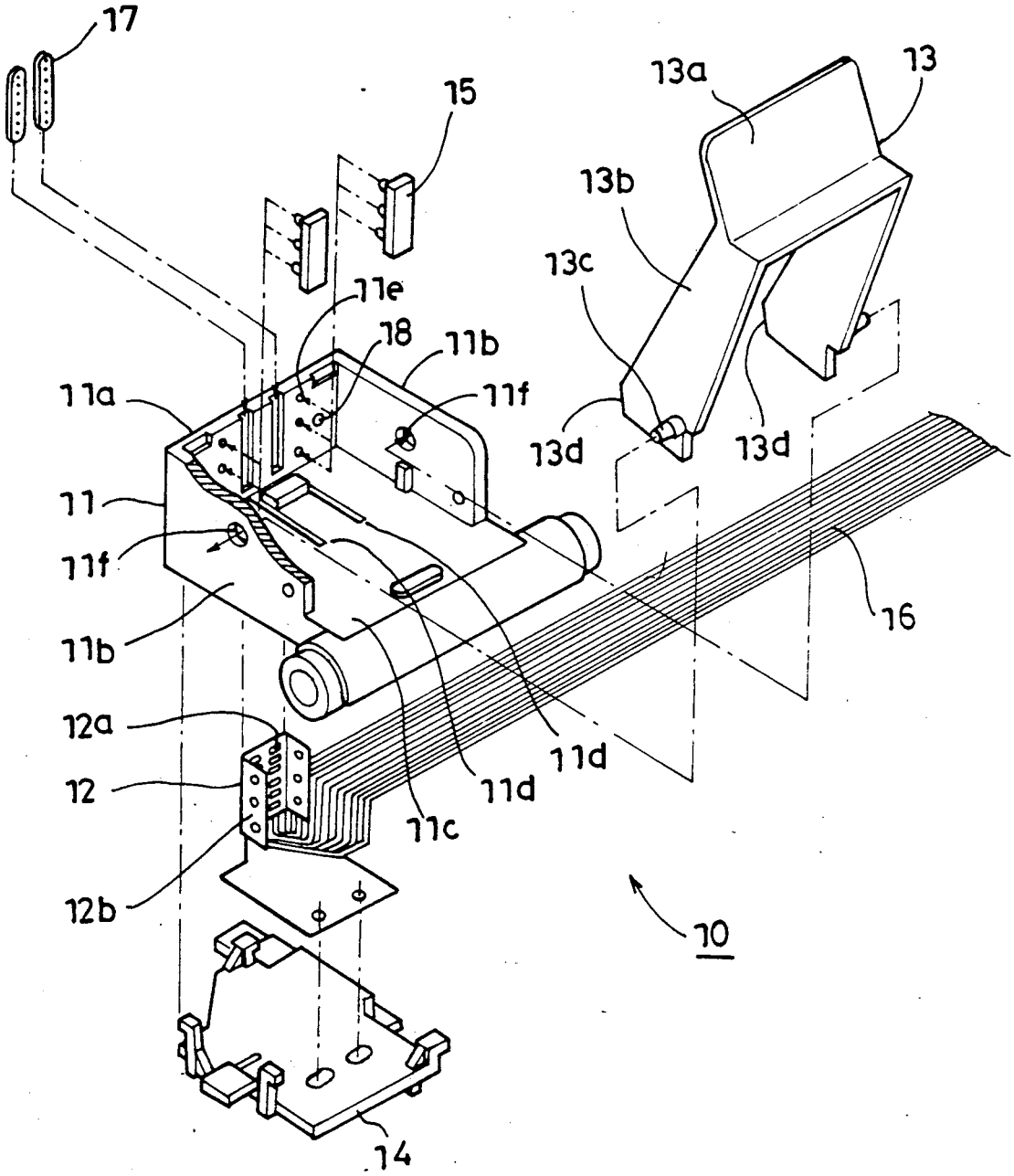
FIG. 1 shows a disassembled view of the cartridge holder for holding in an embodiment of the present invention any one of the printing head cartridges shown in FIGS. 2 and 3.
Figure 2:
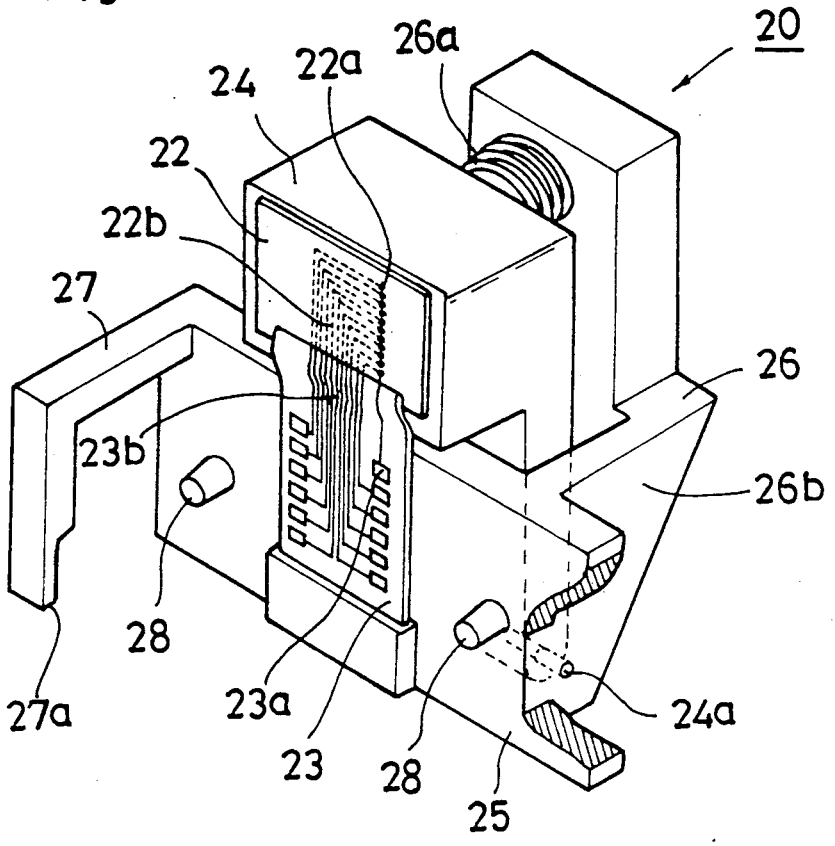
FIG. 2 shows a perspective view of the thermal type printing head cartridge used in the above embodiment.
Figure 3:
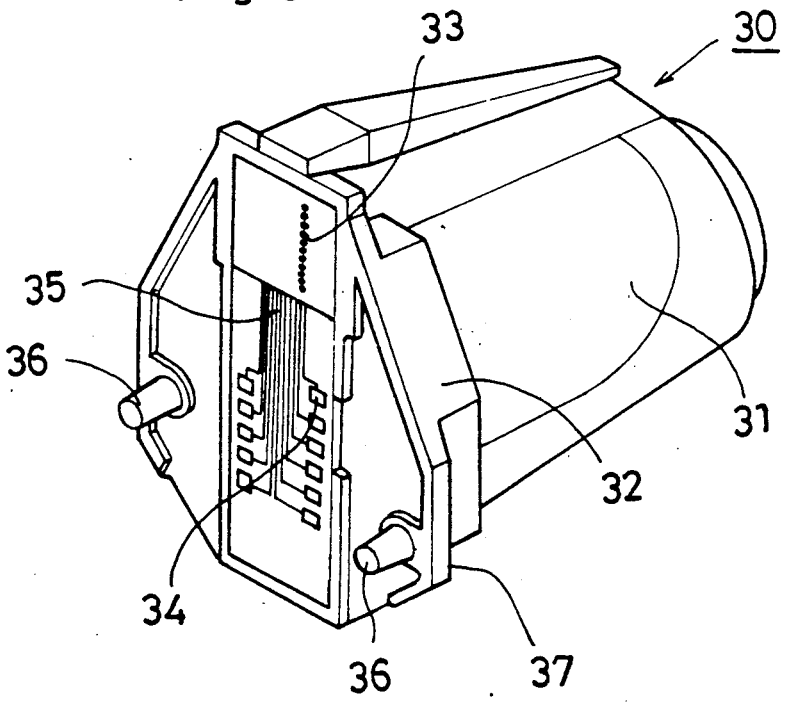
FIG. 3 shows a perspective view of the ink-jet type printing head cartridge used in the above embodiment.

In an embodiment of the present invention, one of two printing head cartridges as shown in FIGS. 2 and 3 is optionally mounted on a common cartridge holder whose disassembled view is shown in FIG. 1.

Referring to FIG. 1 the cartridge holder 10 is constituted essentially of a box-shaped main frame 11, a terminal plate 12, a latch member 13 and a cover plate 14. The main frame 11 consists of a frontal wall 11*a*, two side walls 11*b* and a bottom plate 11*c*. The cartridge holder 10 is positioned so that the frontal wall 11*a* of the main frame 11 may be directed toward a platen roller (not shown) to cooperate with this cartridge holder. The terminal plate 12, which is pictured with both sides 12*b* bent at a right angle, is inserted into the main frame 11 from below with the bent side portions 12*b* through two slits 11*d* of the bottom plate 11*c*. Then, with the two bent sides 12*a* reopened flat, the terminal plate 12 is secured to the inner surface of the frontal wall 11*a* by means of two fixing pin sets 15 with the same engaged with holes 11*e* provided to the frontal wall 11*a*. Between the frontal wall 11*a* and the terminal plate 12 are inserted cushion elements 17. The terminal plate 12 carries a plurality of contact terminals 12*a*, from which parallel lead wires 16 are drawn out with their outlet portion protected by the cover plate 14. The latch member 13 has an angled U-shaped configuration consisting of two parallel leg plates 13*b* linked to each other by a handle plate 13*a*. The two parallel leg plates 13*b* are provided with their respective pivot tenons 13*c* on the lower rear portion and have their lower front corners cut off to form cartridge pressing edges 13*d*. The thus formed latch member 13 is incorporated into the main frame 11 with the pivot tenons 13*c* engaged in bearing holes 11*f* provided to the side walls 11*b* of the main frame 11. The thus assembled cartridge holder accepts a printing head cartridge according to the present invention such that the cartridge has its trunk portion kept between the leg plates 13*b* of the latch member 13. With the latch member 13 turned to a standing posture, the cartridge pressing edges 13*d* press lateral protrusions provided to the cartridge, causing it to be thrusted to the frontal wall 11*a* of the main frame 11 so that the contact terminals 12*a* on the terminal plate 12 may come in contact with corresponding contact terminals provided to the cartridge. A pair of holes 18 (only one of which is seen in FIG. 1) on the frontal wall 11*a* of the main frame 11 is to accept positioning tenons provided, as will be described later, to the cartridge to be mounted on this cartridge holder 10.

The mechanism for making the cartridge holder 10 travel along a platen roller is not mentioned here, since it is out of the subject matter of the invention and may be any conventional one.

FIG. 2 shows a thermal type printing head cartridge 20 to be mounted on the above described cartridge holder 10. This type of printing head cartridge consists essentially of a thermal printer chip 22 on which are formed dot resistors 22*a* and their leads 22*b*, a flexible circuit board 23 carrying thereon printed wirings 23*b* and contact terminals 23*a*, a block-shaped heat radiator (made of aluminum) 24, a radiator stopper 25 and a framework 26 holding the stopper 25. The radiator stopper 25 is provided, on its front surface, with a pair of positioning tenons 28 and a L-shaped arm 27 turning downward rectangularly. The positioning tenons 28 are engaged with the previously mentioned pair of holes 18 (FIG. 1) provided to the cartridge holder 10.

The function of the L-shaped arm 27 is described later. The framework 26 not only holds the heat radiator 24 but also makes both its sides 26*b* pivotally (24*a*) support the lower portion of the heat radiator 24 at the rear of the heat radiator stopper 25 so that the heat radiator 24 may have its upper part exposed above the radiator stopper 25. The printer chip 22 is held from below by the flexible circuit board 23, with their corresponding leads 22*b* and wirings 23*b* electrically connected to each other. The flexible circuit board 23 has its lower end fixed to the front surface of the radiator stopper 25 so that the back of the printer chip 22 may get in touch with the upper part of the heat radiator 24. Further, the framework 26 pushes, by means of a spring 26*a*, the heat radiator 24 toward the radiator stopper 25 (in order to make the printer chip 22 touch a thermal sensitive paper sheet). In the above constitution of this thermal type printing cartridge, both protrusions of the radiator stopper 25 over both the sides 26*b* of the framework 26 have their rear faces made to come into contact with the cartridge pressing edges 13*d* of the latch member 13 (FIG. 1) of the cartridge holder 10. A side view of the cartridge holder 10 carrying thereon this thermal type printing head cartridge 20 is shown, in conjunction with a platen roller 40, in FIG. 4. A reference numeral 50 indicates a photosensor, which is shaded by the tip of the above-mentiond L-shaped arm 27. The photosensor 50 is to judge the thermal type printing head cartridge 20 to be mounted on the cartridge holder 10.

Figure 4:
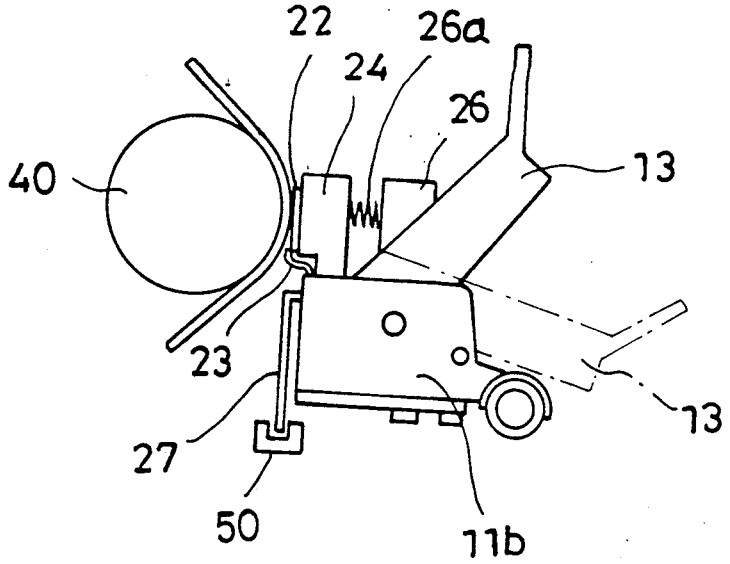
FIG. 4 shows a side view illustrating the state that the thermal type printing head cartridge shown in FIG. 2 is mounted on the cartridge holder shown in FIG. 1.
Figure 5:
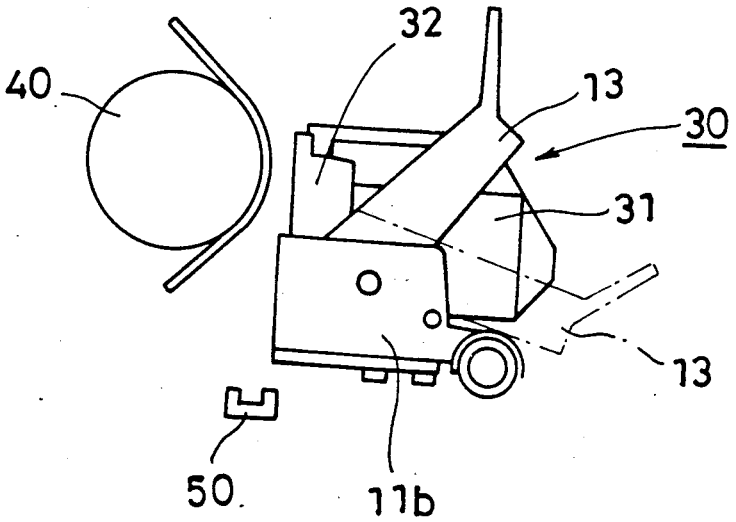
FIG. 5 shows a side view illustrating the state that the ink-jet type printing head cartridge shown in FIG. 3 is mounted on the cartridge holder shown in FIG. 1.

FIG. 3 shows an ink-jet type printing head 30 to be mounted, as a substitution for the thermal type printing head cartridge 20, on the cartridge holder 10 shown in FIG. 1. This type of printing head cartridge consists essentially of an ink reservoir 31 and a front plate 32 carrying thereon ink jet nozzles 33, contact terminals 34, electric leads 35 connecting the contact terminals 34 to ink-jet firing resistors (not shown) built in the cartridge. The front plate 32 is further provided with a pair of positioning tenons 36. The resistors built in the cartridge are located near the not shown capillaries connecting the ink-jet nozzles 33 and the ink reservoir 31, and make ink jets by being electrically energized. Since the functional principle and detailed inner construction of the ink-jet type printing head are conventionally known and out of the subject matter of the invention, their further description is omitted here. In this ink-jet type printing head cartridge 30 the ink reservoir 31 constitutes the trunk portion of the cartridge, and the front plate 32 has its protrusions 37 made to come into contact with the cartridge pressing edges 13*d* of the latch member 13 (FIG. 1) of the cartridge holder 10. A side view of the cartridge holder 10 carrying this ink-jet type printing head cartridge 30 is shown in FIG. 5, in conjunction with the same platen roller 40 as shown in FIG. 4. FIG. 5 also shows the photosensor 50. In this case the photosensor 50 is left exposed to ambient light.

In the following is described an electronic circuit for energizing the resistors of the above two types of printing head cartridge. The pulse currents to be supplied to the dot resistors 22*a* of a the thermal type cartridge (FIG. 2) and those to be supplied to the above-mentioned not shown ink-jet firing resistors of the ink-jet type cartridge 30 (FIG. 3) are, in general, necessarily different in pulse width in accordance with their respective different functions; the dot resistors 22*a* heat a thermal sensitive paper sheet itself inserted on the platen roller 40 (FIG. 4), while the ink-jet firing resistors heat, to fire ink-jets, the capillaries (not shown) connecting between the ink-jet nozzles 33 and the ink reservoir 31.

Figure 6:
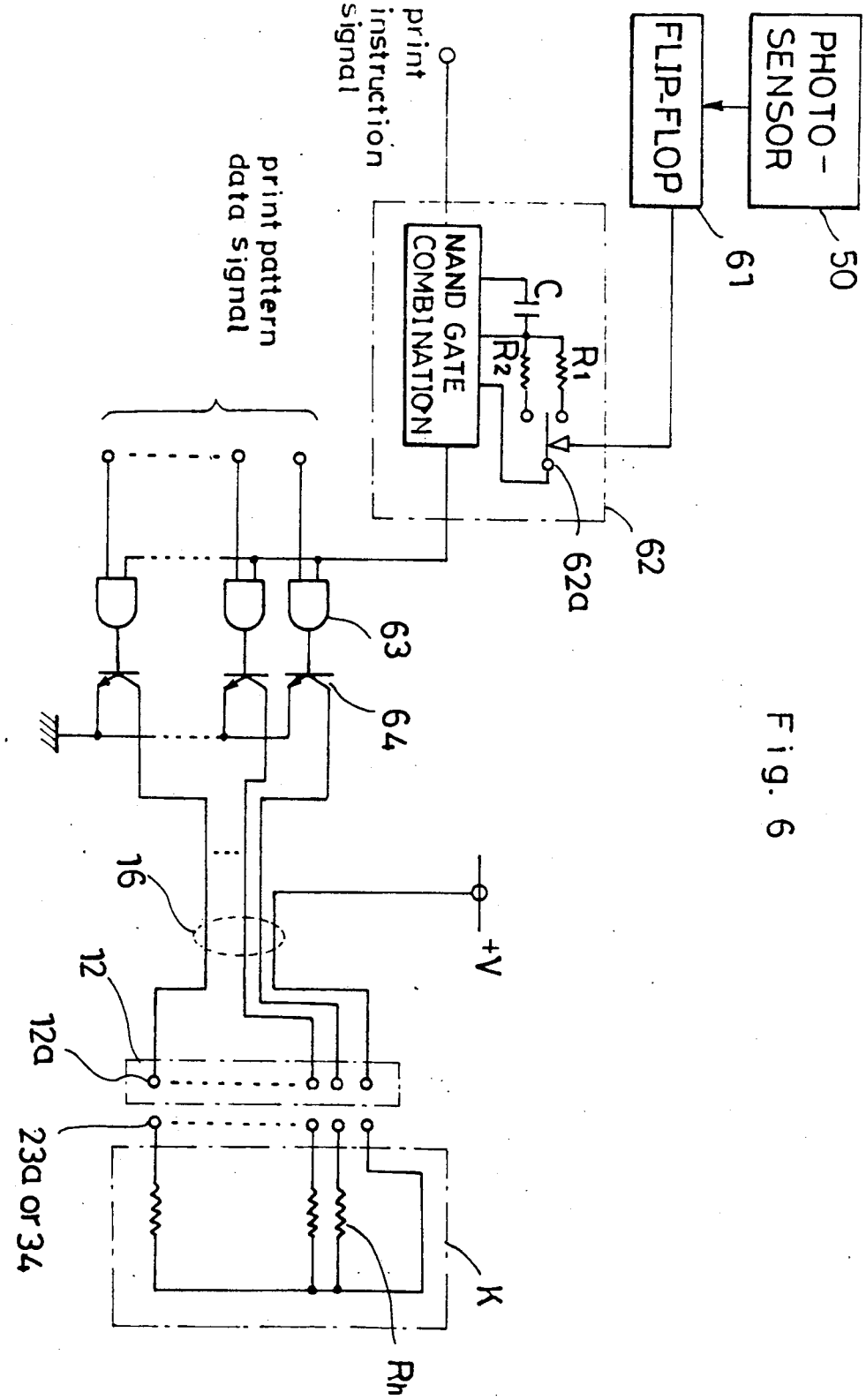
FIG. 6 shows an electronic circuit for supplying, in the above embodiment, pulse currents to the printing head cartridges shown in FIGS. 2 and 3.

Referring to FIG. 6, which shows a circuit constitution for energizing the ink-jet firing resistors of the printing head cartridges shown in FIGS. 2 and 3, the photosensor 50 (refer also to FIGS. 4 and 5) has its output signal inputted to a flip-flop 61. Thus the flip-flop 61 outputs a high-level signal according to the type of the cartridge mounted on the cartridge holder 10. Namely, when the the thermal type printing head cartridge 20 is set on the cartridge holder 10, the photosensor 50 has its output depressed to zero level by being shaded by the L-shaped arm 27 (refer to FIG. 4) causing the output of the flip-flop 61 to turn low level (or high level), whereas, since the ink-jet type printing head cartridge is not provided with a photosensor shading means, the photosensor 50 outputs a positive signal, causing the fip-flop 61 to turn high level (or low level). According to the level of the flip-flop output, a one-shot multivibrator 62 has its time constant changed to either $CR_1$ or $CR_2$. The one-shot multivibrator 62, triggered by printing instruction signals, thus outputs pulse signals with their width changed in accordance with type of printing head cartridge mounted on the cartridge holder 10. The pulses outputted from the one-shot multivibrator 62 define the gate opening period of AND gates 63 to which print pattern data signals are inputted. In this manner, transistors 64 can supply to dot resistors $R_h$ (representing the resistors 22*b* of the thermal type printing head cartridge 20 or the built-in ink-jet firing resistors of the ink-jet type printing head cartridge 30) resistor-heating pulse currents with their width varied in accordance with the type of the printing head cartridge mounted on the cartridge holder 10. In FIG. 6 the cartridge optionally selected is represented, with its contact terminals 22a or 34 excluded, by a reference symbol K.

Needless to say, the above embodiment can be modified so as to function similarly with the photosensor shading arm (27) provided not to the thermal type printing head cartridge but to the ink-jet type printing head cartridge.

The present invention is further embodied in another way, in which the type of the printing head cartridge mounted on the cartridge holder 10 is identified by making use of a difference in resistance of the resistors installed in the two types of printing head cartridges. In this embodiment, all the constituents other than the electronic circuit portion are substantially the same as those of the above described and mentioned embodiment and modification, excepting that there is no photosensor needed and that, therefore, neither of the two types of printing head cartridge is provided with a photosensor shading arm.

Figure 7:
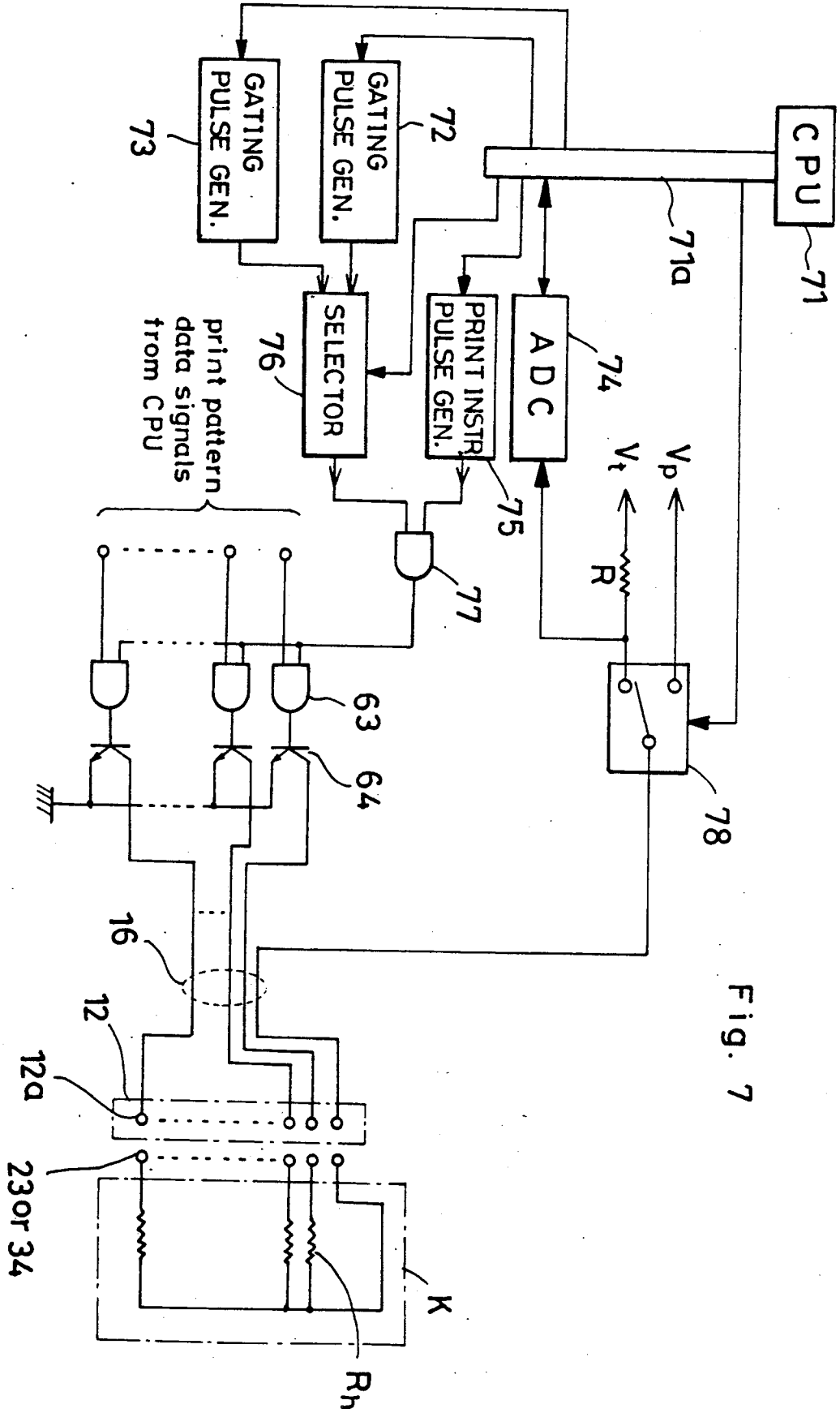
FIG. 7 shows an electronic circuit for supplying, in another embodiment of the present invention, pulse currents to printing head cartridges substantially the same as those shown in FIGS. 2 and 3.

FIG. 7 shows the microcomputerized electronic circuit for controlling, in this embodiment, current supply to the printing head cartridge mounted on the cartridge holder 10. In FIG. 7 the components common to those used in the circuit shown in FIG. 6 are indicated with the same reference numerals and signs used in FIG. 6.

In this circuit the transistors 64 have their collector circuits (with the resistors $R_h$ included in series) current-supplied, through a switch 78, from either of two voltage sources supplying voltages $V_p$ and $V_t$, respectively. The voltage $V_t$ is selected for judging which type of printing head cartridge is mounted on the cartridge holder 10, while the printing is carried out with the voltage $V_p$ selected. The line related to the voltage $V_t$ contains a resistor R in series. The voltage $V_t$ is kept low enough (5 volts for example) to avoid operating a printing head cartridge, if mounted, during the process of judging the type of the cartridge. On the other hand, the voltage $V_p$ for operating a printing head cartridge is typically 24 volts. Further, the AND gates 63 switching the transistors 64 have their gate signals are supplied from an AND gate 77. The switch 78 is operated by an instruction of a CPU 71, which not only controls, through a bus line 71a, also an A–D converter (analog-to-digital converter) 74, a print instruction pulse generator 75, two gating pulse generators 72, 73 and a selector 76, but also normally supplies print pattern data signals to the AND gates 63.

In such a circuit constitution, with the switch 78 turned to the line supplying the voltage $V_t$ in the beginning, the print intruction pulse generator 75 and the gating pulse generator 72 output, respectively, a series of test pulses (which are not print instruction pulse signals) and another series of pulses covering said test pulses, with the selector 76 made to select the output from the gating pulse generator 72, and, at the same time, the CPU 71 directly supplies to the AND gates 63 pulses (which are not print pattern data signals) equal to those outputted from the gating pulse generator 72. Thus, the transistors 64 are switched on for said test pulses. Under the circumstances, if no printing head cartridge is mounted on the cartridge holder 10, the resistor R outputs the voltage $V_t$ as it is since the transistors 64 do not have their collector circuits completed with resistors $R_h$. The A–D converter 74, instructed by the CPU 71, picks up and inputs the voltage $V_t$ to the CPU 71. Then the CPU 71 judges any one of the printing head cartridges not to be mounted on the cartridge holder 10, and indicates the situation on a not shown display means or through any suitable alarm means. If any one of the two types of printing head cartridges has been mounted or is mounted according to the indication by the CPU 71, a series of pulse current reflecting the above mentioned test pulses flow the collector circuits of the transistors 64, causing a potential drop on the resistor R. Since the potential drop depends on the resistance of the resistors $R_h$, namely on the type of the printing head cartridge mounted on the cartridge holder 10, the CPU 71 judges, from a voltage outputted from the A–D converter 74, which type printing head cartridge is mounted.

According to the type of the printing head cartridge mounted on the cartridge holder, the CPU 71 instructs, with the switch turned to the line of the voltage $V_p$, the print instruction pulse generator 75 to output predetermined print instruction pulse signals, and either of the two gating pulse signal generators 72 and 73 to output gating pulses covering the print instruction pulse signals. In this case the CPU 71 instructs, of course, the selector 76 to select the output of the gating pulse generator 72 or 73 outputting the gating pulses. Under the circumstances, with the AND gates 63 supplied with print pattern data signals, the printer functions either as a thermal type printer or as an ink-jet type printer. Of course, the print pattern data signals are not directly inputted to the AND gates 63 externally, but they are converted to coded signals by the CPU 71 and then inputted to the AND gates 63. The process of coding the print pattern data signals is well-known, and has its description is omitted here.

Incidentally, although the traveling of the cartridge holder 10 is also controlled by the CPU 71, the details of the cartridge holder control function of the CPU 71 is also omitted in the present specification together with the mechanism of making the holder travel, since they are conventional and out of the subject matter of the invention.

We claim:

1. A printer for printing characters, symbols and patterns on a paper sheet placed on a platen roller by means of a printing head, said printer comprising:

a carriage adapted so as to interchangeably on hold ink-jet printing head cartridge and thermal printing head cartridge, said carriage comprising a framework, a terminal plate having a plurality of first contact terminals, said framework being provided with a pair of cartridge-positioning recesses, and said terminal plate being fixed to said framework by means of pins with cushion members inserted between said terminal plate and said framework;

said ink-jet printing head cartridge provided with a pair of cartridge-positioning tenons arranged so as to be received by said cartridge-positioning recesses, said ink-jet printing head cartridge having a plurality of second contact terminals electrically connected to corresponding ink-jet firing resistors built in said ink-jet printing head cartridge, said second contact terminals being arranged so as to come into contact with said first contact terminals when said ink-jet printing head cartridge is held by said carriage;

said thermal printing head cartridge provided with a pair of cartridge-positioning tenons arranged so as to be received by said cartridge-positioning recesses, said thermal printing head cartridge having a plurality of third contact terminals electrically connected to corresponding dot resistors of said thermal printing head cartridge, said third contact terminals being arranged so as to come into contact with said first contact terminals when said thermal printing head cartridge is held by said carriage;

a cartridge identification means for identifying which one of said ink-jet printing head cartridge or said thermal printing head cartridge is held by said carriage; and an electric circuit for supplying said ink-jet firing resistors and said dot resistors with pulse currents having a pulse width which is varied according to a cartridge identification signal outputted from said cartridge identification means, whereby said printer is made capable of interchangeably functioning as an ink-jet printer and as a thermal type printer.

2. A printer as defined in claim 1, wherein said cartridge identification means consists of a photosensor provided to said carriage and a shading means provided to said thermal printing head cartridge, said shading means being shaped so as to shade said photosensor when said thermal printing head is held by said carriage.

3. A printer as defined in claim 1, wherein said cartridge identification means consists of a photosensor provided to said carriage and a shading means provided to said ink-jet printing head cartridge, said shading means being shaped so as to shade said photosensor when said ink-jet printing head is held by said carriage.

* * * * *

UNITED STATES PATENT AND TRADEMARK OFFICE

CERTIFICATE OF CORRECTION

PATENT NO. : 5,049,904

DATED : September 17, 1991

INVENTOR(S) : Mitsuaki Nakamura, et al

It is certified that error appears in the above-identified patent and that said Letters Patent is hereby corrected as shown below:

On the title page, Item [75]

[75] Inventors: Add --Shingo Takimoto--

Signed and Sealed this

Third Day of August, 1993

*Attest:*

Michael K. Kirk

MICHAEL K. KIRK

*Attesting Officer*

*Acting Commissioner of Patents and Trademarks*